US005663021A

United States Patent [19]

Hosoi et al.

[11] Patent Number: 5,663,021

[45] Date of Patent: Sep. 2, 1997

[54] FILM FOR ELECTROPHOTOGRAPHIC TRANSFER, COLOR TONER, AND METHOD OF COLOR IMAGE FORMATION

[75] Inventors: Kiyoshi Hosoi; Tsukasa Matsuda, both of Ebina; Masanori Ichimura, Minami-ashigara; Yuka Ishihara, Minami-ashigara; Takashi Sakai, Minami-ashigara, all of Japan

[73] Assignee: Fuji Xerox Co., Ltd., Tokyo, Japan

[21] Appl. No.: 657,093

[22] Filed: Jun. 4, 1996

[30] Foreign Application Priority Data

Jun. 6, 1995 [JP] Japan ..... 7-139284

[51] Int. Cl.[6] ..... G03G 13/16

[52] U.S. Cl. ..... 430/47; 430/126; 428/195

[58] Field of Search ..... 428/195, 285, 428/286; 430/96, 47, 126

[56] References Cited

U.S. PATENT DOCUMENTS

| | | | |
|---|---|---|---|
| 5,229,188 | 7/1993 | Takeuchi et al. | 428/195 |
| 5,352,553 | 10/1994 | Takeuchi et al. | 430/42 |
| 5,479,311 | 12/1995 | Doushita et al. | 360/132 |

FOREIGN PATENT DOCUMENTS

| | | |
|---|---|---|
| 59-184361 | 10/1984 | Japan . |
| 60-52861 | 3/1985 | Japan . |
| 61-36756 | 2/1986 | Japan . |
| 61-36762 | 2/1986 | Japan . |
| 63-80273 | 4/1988 | Japan . |
| 2-263642 | 10/1990 | Japan . |
| 3-198063 | 8/1991 | Japan . |
| 4-125567 | 4/1992 | Japan . |
| 4-212168 | 8/1992 | Japan . |
| 5-88400 | 4/1993 | Japan . |

*Primary Examiner*—John Goodrow
*Attorney, Agent, or Firm*—Oliff & Berridge

[57] ABSTRACT

A film for electrophotographic transfer comprising a transparent plastic film having a heat resistance temperature of 100° C. or higher having provided on at least one side thereof a transparent resin layer, wherein the transparent resin layer comprises a polyester resin having a peak count value (A) in GPC molecular weight measurement which satisfies relationship: $-30 \leqq A-B \leqq +20$, in which B is a peak count value of the binder resin of a color toner used for fixing, and an initial count value (Cp) in the GPC molecular weight measurement which satisfies relationship: $-500 \leqq Cp-Ct \leqq -200$, in which Ct is an initial count value in the GPC molecular weight measurement of the binder resin of a color toner used for fixing, or a polyester resin having a weight average molecular weight of from 15000 to 40000 and a weight average molecular weight to number average molecular weight ratio of from 3.5 to 10; the transparent resin layer has a thickness of from 1 to 8 μm, and the transparent resin layer forms a contact angle of not more than 50° with a color toner to be fixed thereon in a molten state at a fixing temperature.

8 Claims, 7 Drawing Sheets

FILM FOR ELECTROPHOTOGRAPHIC TRANSFER, COLOR TONER, AND METHOD OF COLOR IMAGE FORMATION

FIELD OF THE INVENTION

This invention relates to a film used as a material to be transferred in color copying machines or printers according to indirect dry process full color electrophotography, an electrophotographic color toner used for developing the film, and a method of color image formation by heat and pressure fixing the film with the color toner.

BACKGROUND OF THE INVENTION

An image formation system comprising forming a toner image on a transparent film by indirect dry process electrophotography and projecting the image by means of an overhead projector (hereinafter referred to as an OHP) has been widely spread. In particular, with the recent spread of indirect dry process full color electrophotographic copying machines or printers, color image formation on a transparent film for use on OHP has been increasing. Hence, a film to be transferred for electrophotography (hereinafter sometimes referred to as a film for electrophotographic transfer) which provides a projected image with satisfactory color formation has been in demand.

A conventional film to be transferred for black-and-white indirect dry process electrophotography has improved running properties and improved toner fixing properties. However, when it is used in an indirect dry process full color electrophotographic copying machine or printer, it fails to provide a satisfactory projected color image. That is, the projected image becomes cloudy, lacking color formation properties particularly in the middle tone, since the incident light from an OHP is greatly refracted at the interface between a toner image and air.

In order to solve the above problem, it is necessary to reduce the unevenness of a toner image formed on a transparent film. To this effect, various methods have been proposed to date.

For example, JP-A-59-184361 (th term "JP-A" as used herein means an "unexamined published Japanese patent application") proposes to spray lacquer on a toner image surface. However, a binder resin of a toner is dissolved by the solvent, which deteriorates image sharpness and causes color unevenness and background stains.

JP-A-60-52861 discloses a method of covering a toner image with a laminate film. JP-A-61-36756 and JP-A-61-36762 discloses a method comprising superimposing a transparent film on a toner image, fixing the toner by applying a heat roll via the film, and then removing the film. However, these methods involve an increased number of steps after image formation and tend to destroy the toner image when a transparent film is stripped off.

JP-A-63-80273 proposes a method of fixing a toner image with a roller at a high temperature for a toner be sufficiently melted; a method of fixing using a solvent, such as toluene; a method of fixing comprising abrading the surface of a fixed toner image; and a method of fixing comprising applying a transparent coating which does not dissolve a toner to the fixed toner image. However, the roller fixing method at a high temperature is disadvantageous in that the unevenness in the areas with a lesser amount of a toner, such as a middle tone area, cannot be reduced without causing offset on a the areas with a larger amount of a toner. Use of a non-contact heat fixing apparatus, such as an oven, not only causes waviness of the transparent film but requires a considerably long fixing time for ensuring sufficient light transmitting properties. The fixing method using a solvent is disadvantageous in that the fluidity of the toner in a middle tone area cannot be increased to a degree sufficient for reducing the unevenness without causing the toner in a high density area to be destroyed and run away. The method of abrading a toner image brings about improved light transmitting properties in areas with a relatively large amount of a toner but cannot achieve sufficient reduction of unevenness in low density areas. The method of applying a transparent coating which does not dissolve a toner tends to form a distinct boundary on the toner image. It would follow that incident light is scattered at the boundary only to provide a dark, low saturation projected image.

In order to solve these problems, the following proposals have been made later.

JP-A-3-198063 discloses an OHP sheet capable of forming a smoothed toner image thereon, which has an image-receiving layer comprising a resin whose melting point is higher than the glass transition point of a toner binder resin and whose melt viscosity is lower than that of the toner binder resin. JP-A-4-125567 proposes a method for leveling the unevenness of a toner image, which comprises providing a toner image-holding layer containing a thermoplastic resin whose softening point is lower than that of a toner binder resin.

JP-A-4-212168 proposes a method comprising forming a coating layer comprising a resin whose fluidizing temperature is lower than that of a toner binder resin to give gloss to the toner image, thereby increasing color reproducibility of the projected image. JP-A-5-88400 proposes a method for eliminating unevenness of a toner image, in which a transparent resin layer having a lower apparent melt viscosity than a toner binder resin at a fixing temperature is provided.

If a resin whose melt viscosity or softening point is lower than that of a toner binder resin is used in an image-receiving layer as described above, the transparent resin of the image-receiving layer becomes soft earlier than the toner upon being heated with a fixing roll, which leads to various troubles. That is, the transparent resin layer is liable to stick to the fixing roll to cause an offset phenomenon; the image area suffers from fine waviness to make a shell-like pattern, which causes cloudiness of a projected image; and the transparent resin layer is caught by the fixing roll and, as a result, some image areas disappear, or the OHP film itself is caught and wound around the fixing roll (hereinafter the phenomenon is referred to as offset).

JP-A-2-263642 describes a method for reducing unevenness of a toner image formed on a transparent film thereby to eliminate an offset phenomenon, which comprises providing on a transparent film a transparent resin layer having a specific solubility parameter for compatibility with a toner binder resin and a higher dynamic elastic modulus than the toner binder resin at a fixing temperature. However, only the adjustment of solubility parameter is not enough for obtaining compatibility between the toner and the transparent resin sufficient for a molten toner be embedded in the transparent resin layer. Therefore, the above proposal still fails to reduce the unevenness of a toner image, only to provide a projected image having poor color formation in the middle tone area.

SUMMARY OF THE INVENTION

An object of the invention is to provide a film to be transferred for electrophotography which can form thereon a toner image having reduced unevenness and thereby capable of providing a projected image with improved color formation and which causes no offset; an electrophotographic color toner used for image formation on the film; and a method of image formation using the film and the color toner.

The above object of the invention is accomplished by:

(1) a film for electrophotographic transfer comprising a transparent plastic film having a heat resistance temperature of 100° C. or higher having provided on at least one side thereof a transparent resin layer comprising a polyester transparent resin, wherein the peak count value (A) of the molecular weight distribution of the transparent resin as measured by gel-permeation chromatography (hereinafter abbreviated as GPC) and the peak count value (B) of the binder resin of a color toner used for fixing as measured by GPC satisfy relationship (1):

$$-30 \leqq A-B \leqq +20 \quad (1)$$

the initial count value in the GPC molecular weight measurement of the transparent resin (Cp) and the initial count value in the GPC molecular weight measurement of the binder resin of a color toner used for fixing (Ct) satisfy relationship (2):

$$-500 \leqq Cp-Ct \leqq -200 \quad (2)$$

the transparent resin layer has a thickness ranging from 1 to 8 μm, and the transparent resin layer forms a contact angle of not more than 50° with a color toner to be fixed thereon in a molten state at a fixing temperature;

(2) a film for electrophotographic transfer comprising a transparent plastic film having a heat resistance temperature of 100° C. or higher having provided on at least one side thereof a transparent resin layer comprising a polyester transparent resin, wherein the transparent resin has (i) a weight average molecular weight (Mw) of from 15000 to 40000 and (ii) a weight average molecular weight (Mw) to number average molecular weight (Mn) ratio of from 3.5 to 10, the transparent resin layer has a thickness ranging from 1 to 8 μm, and the transparent resin layer forms a contact angle of not more than 50° with a color toner to be fixed thereon in a molten state at a fixing temperature;

(3) an electrophotographic color toner used for image formation on the film for electrophotographic transfer described in (1) or (2) above, wherein the color toner comprises a polyester resin as a binder resin; and (4) a method for color image formation comprising developing an electrostatic latent image with the color toner described in (3) above to prepare a color toner image, transferring the color toner image on the film for electrophotographic transfer described in (1) or (2) above to prepare a transferred toner image, and fixing the transferred image under heat and pressure.

DETAILED DESCRIPTION OF THE INVENTION

Figure 1:
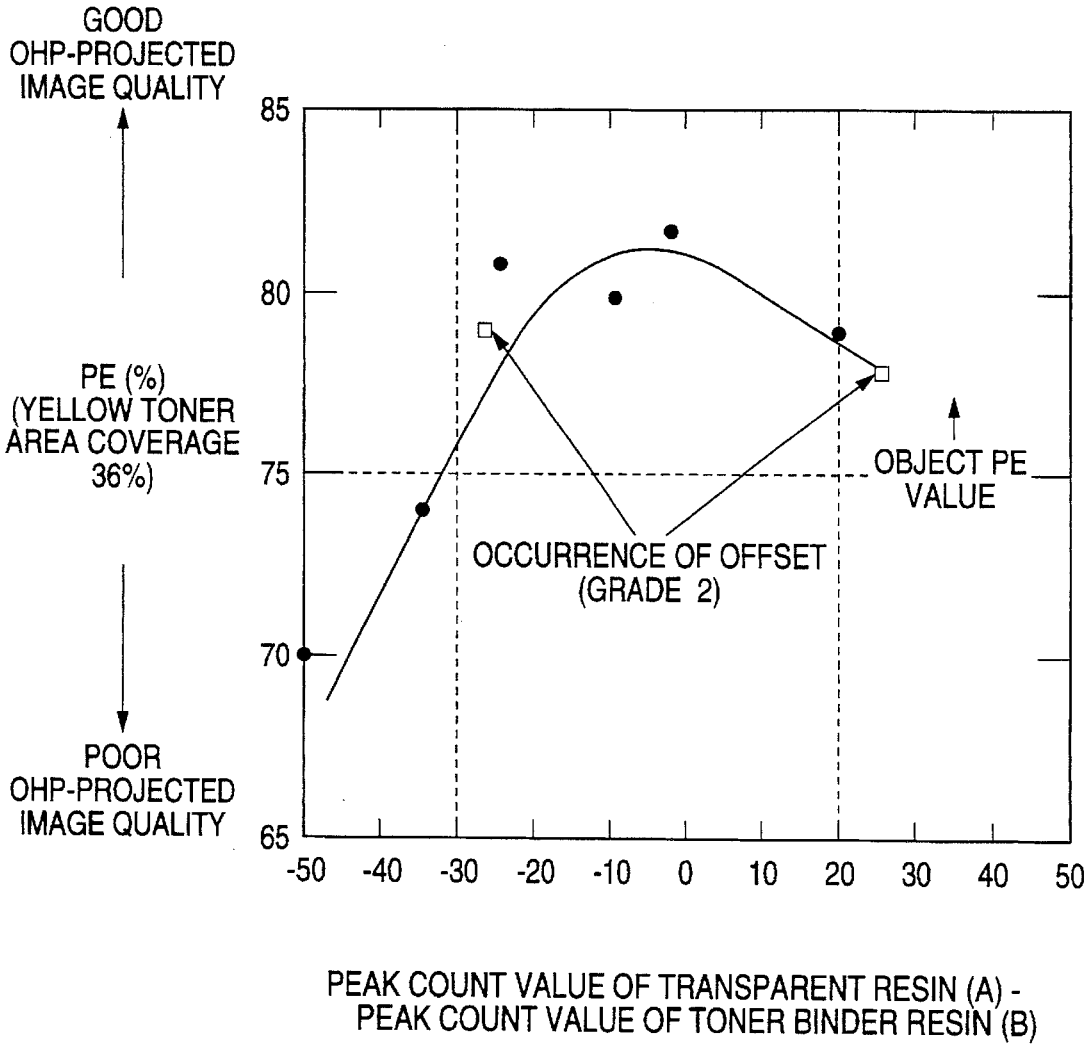
FIG. 1 is a graph showing the influence of the difference between the peak count value of a polyester resin of a transparent resin layer and that of a toner binder resin on OHP projected image quality and occurrence of offset.

Aiming at improvement in color formation properties of a projected image of a film for electrophotographic transfer and prevention of offset of a transparent resin layer, the inventors have conducted extensive study particularly on the characteristics of the resin used in the transparent resin layer. As a result, they have found that the relation between the molecular weight distribution of the binder resin of a toner to be fixed and that of the transparent resin, the weight average molecular weight of the transparent resin, the relation between the weight average molecular weight and the number average molecular weight of the transparent resin, the coating thickness of the transparent resin layer, and the compatibility between the transparent resin and the toner binder resin greatly concern the above-described problems. The present invention has been completed based on this finding.

In order to improve color reproducibility of a projected color image, it is necessary to prevent irregular reflection of incident light on the surface of the film for electrophotographic transfer and in the inside of the transparent resin layer. To this effect, it is necessary that the color toner image (especially in the middle tone area) formed on the transparent resin layer should have small unevenness and that the toner binder resin and the transparent resin layer should be thoroughly dissolved in each other. That is, it is important that the transparent resin layer be softened at the temperature at which the toner binder resin melts and that the transparent resin and the toner binder resin be compatible with each other as expressed by a small contact angle of a molten toner with the OHP film.

On the other hand, it is important for improvement of anti-offset properties that the transparent resin should not become too soft at the temperature at which the toner binder resin melts.

Thus, the color formation properties of a projected image and the anti-offset properties have been generally accepted to be conflicting to each other and difficult to improve at the same time. To the contrary, the inventors reached the following findings in their study paying attention to the relation between the toner binder resin to be fixed and the transparent resin in terms of molecular weight distribution and the contact angle formed by a molten color toner on the transparent resin layer. That is, they have found that: occurrence of offset can be inhibited by selecting such a transparent resin as has a peak of molecular weight distribution close to that of a toner binder resin and has a molecular weight distribution reaching down toward the high molecular weight side farther than the toner binder resin; and softening of the toner binder resin is followed by softening of the transparent resin layer serving as an image-receiving layer owing to their close relation in terms of molecular weight distribution peak, by which the color toner is successfully embedded in the resin of the image-receiving layer thereby causing little unevenness of the resulting color toner image. The inventors have thus succeeded in improving both the color formation of a projected image and the anti-offset properties simultaneously.

With the contact angle between the transparent resin and a molten toner being made small, the toner binder resin and the transparent resin mutually melt with each other on fixing, so that light from an OHP could be prevented from being largely refracted in the inside of the transparent resin layer and between the toner image and the transparent resin layer. As a result, the projected image free from cloudiness and excellent in color formation can be obtained.

Figure 3:
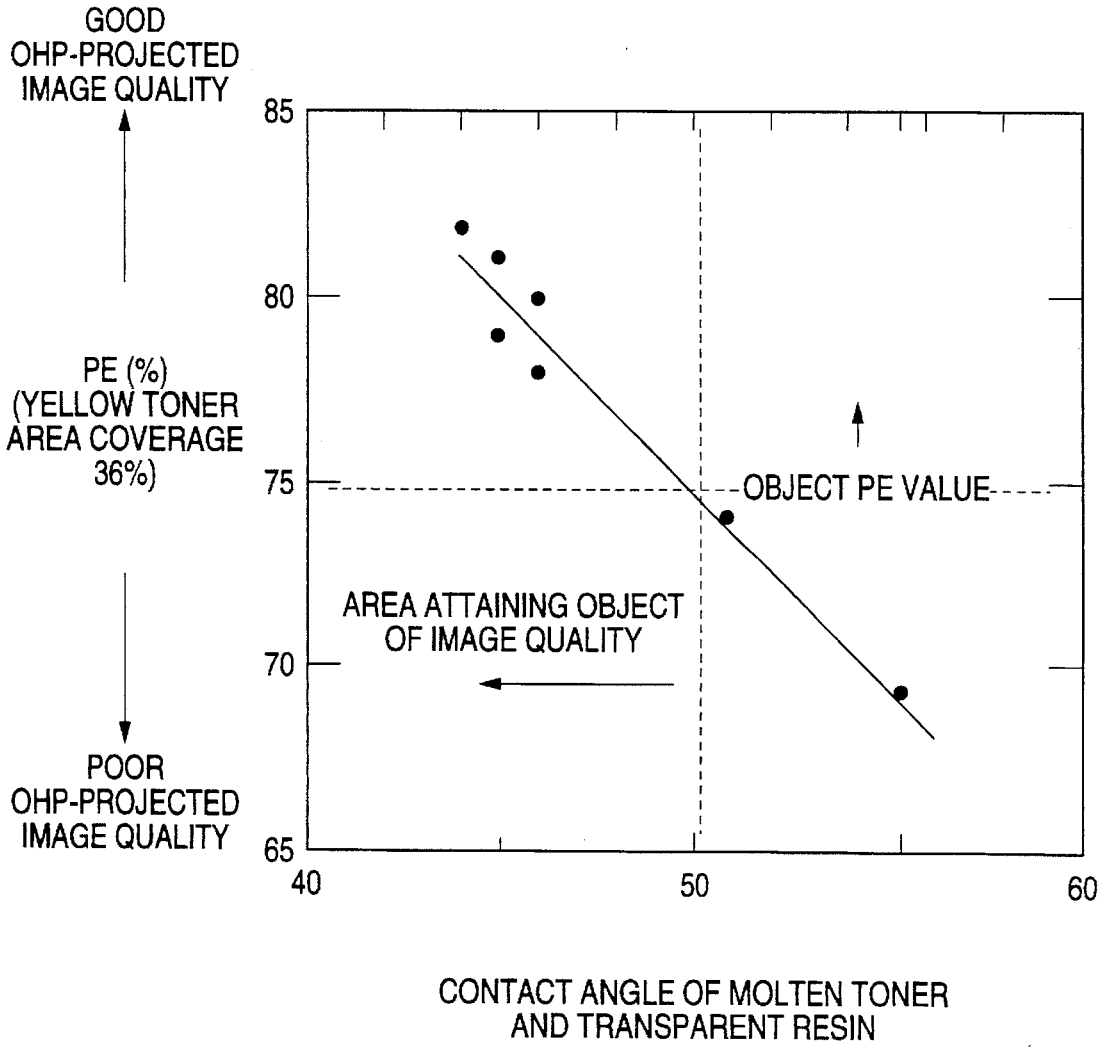
FIG. 3 is a graph showing the influence of the contact angle between a transparent resin layer and a molten toner on OHP projected image quality.

In order to improve both the color formation properties of a projected image and the anti-offset properties, the resin to be used in the transparent resin layer should form a small contact angle with a molten toner as shown in FIG. 3, a peak of molecular weight distribution close to that of a toner binder resin, and a molecular weight distribution reaching down to the high molecular weight side farther than the toner binder resin. However, if the spread to the high molecular weight side is too broad, the resin is hard and generates unevenness in the middle tone area. Accordingly, the transparent resin should have the following specific molecular weight distribution.

Figure 2:
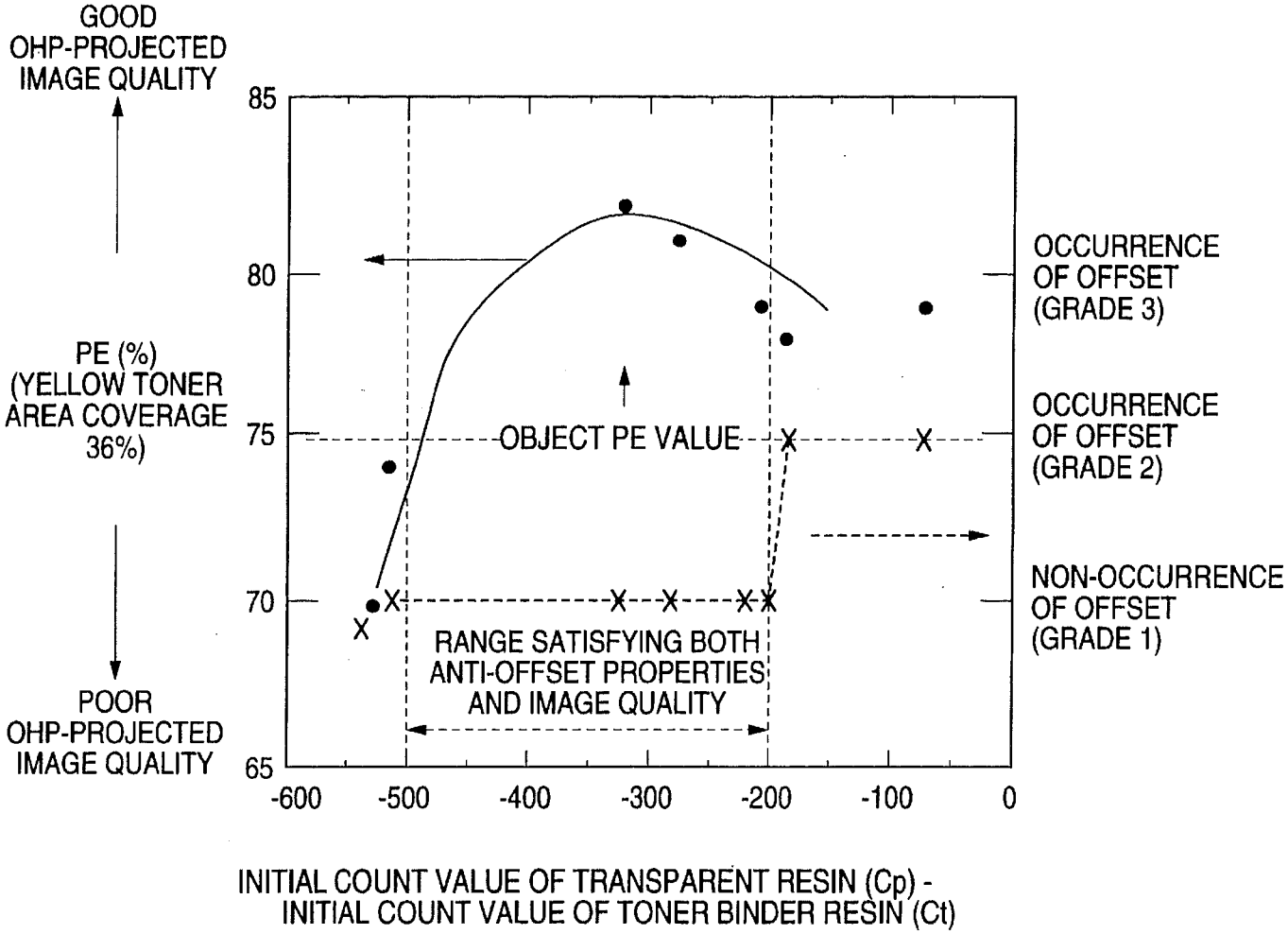
FIG. 2 is a graph showing the influence of the difference between the initial count value of a polyester resin of a transparent resin layer and that of a toner binder resin on OHP projected image quality and occurrence of offset.

The improvement in both the color formation properties of a projected image and the anti-offset properties can be achieved when the peak count value of the molecular weight distribution of the transparent resin (A) and that of the toner binder resin to be fixed (B) satisfy the relationship: $-30 \leqq A-B \leqq +20$ as shown in FIG. 1, and the initial count value in the molecular weight measurement of the transparent resin (Cp) and that of the toner binder resin to be fixed (Ct) satisfy the relationship: $-500 \leqq Cp-Ct \leqq -200$ as shown in FIG. 2.

The terminology "peak count value" as used herein means the count value at the maximum peak in the molecular weight distribution as measured by GPC (hereinafter described). The terminology "initial count value" as used herein means the count value at which a molecular weight is first detectable in the GPC measurement. The smaller the count value, the higher the molecular weight, and vise versa.

Figure 4:
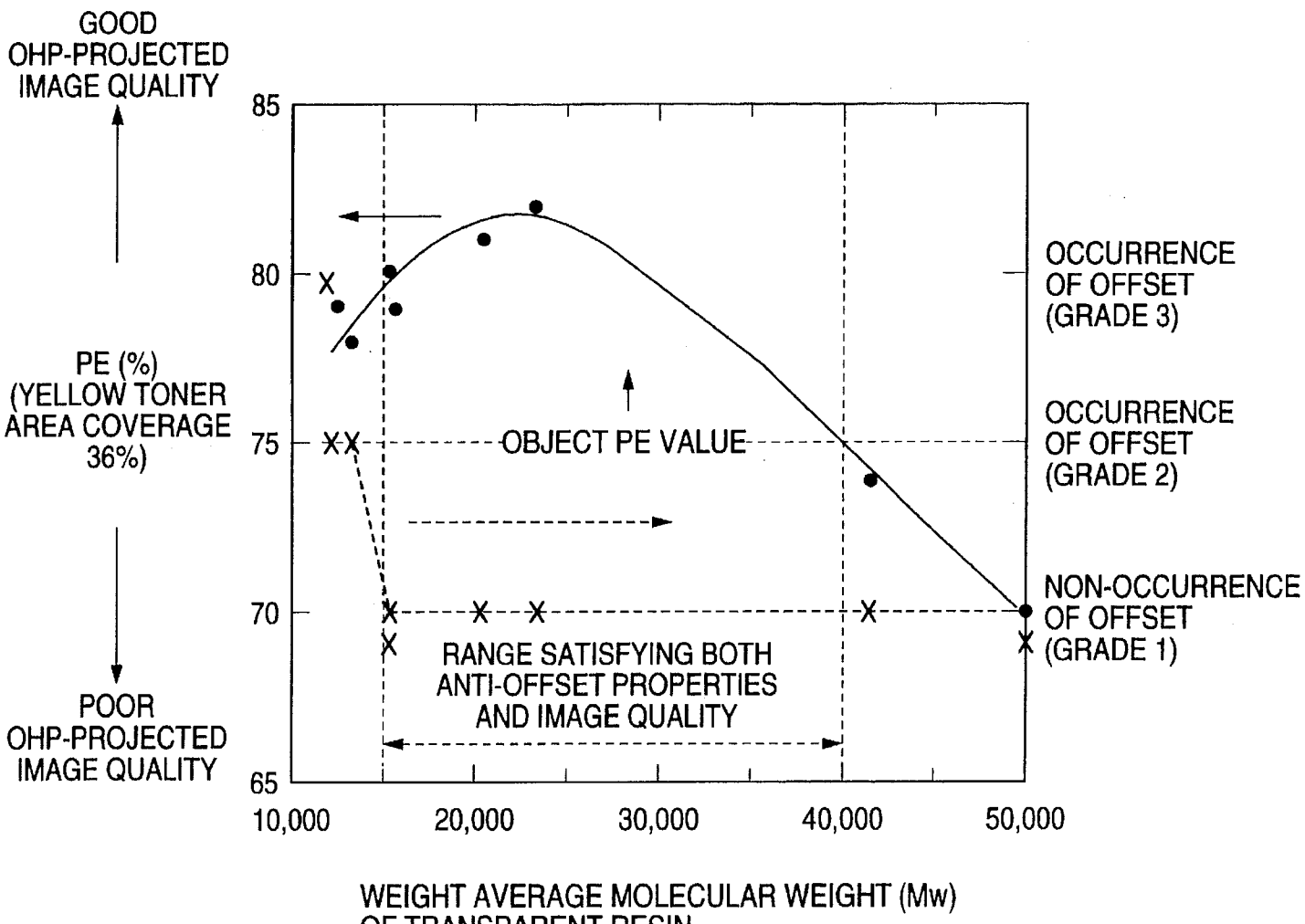
FIG. 4 is a graph showing the influence of the weight average molecular weight of a polyester resin of a transparent resin layer on OHP projected image quality and occurrence of offset.
Figure 5:
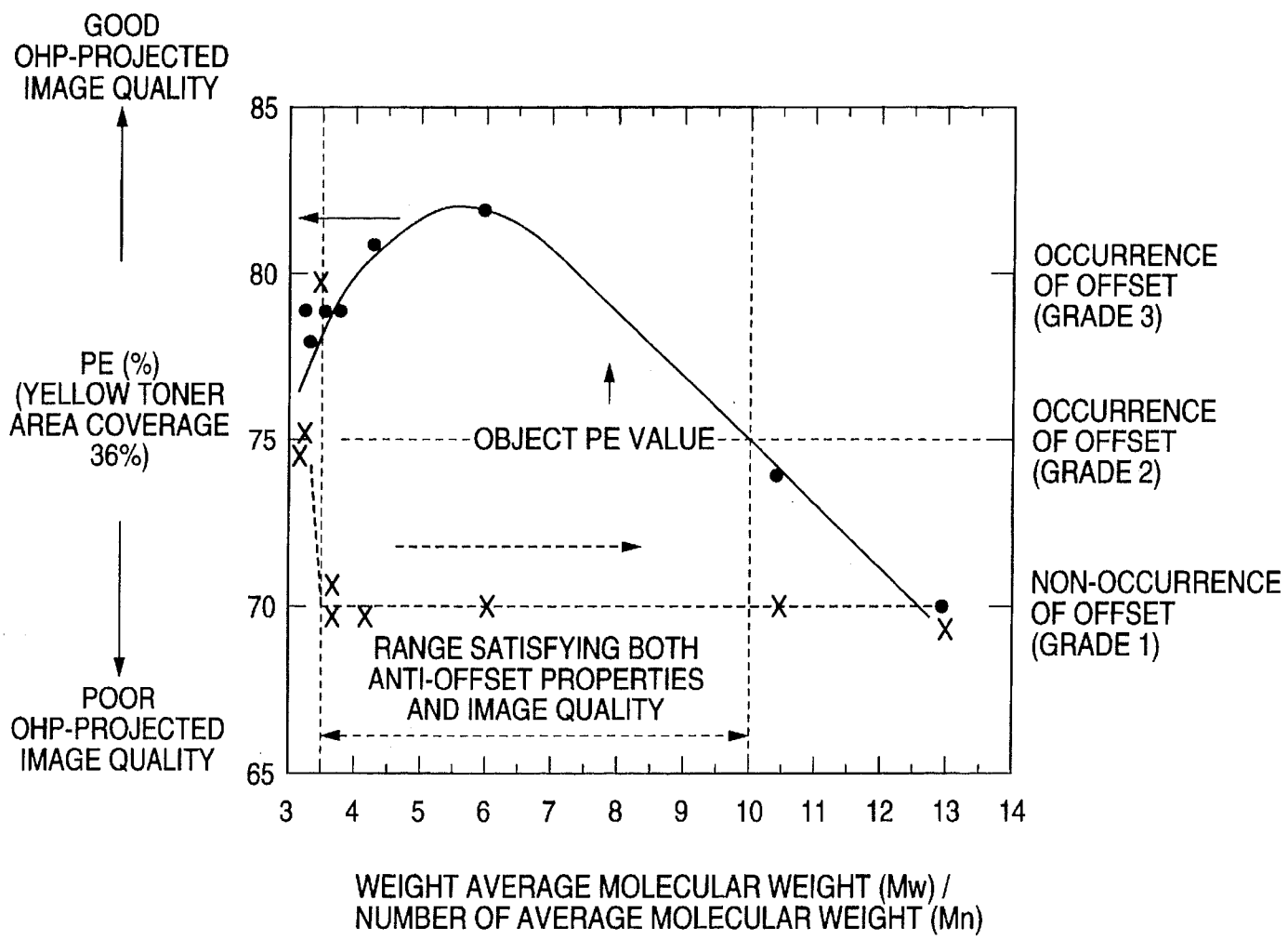
FIG. 5 is a graph showing the influence of the weight average molecular weight to number average molecular weight ratio of a polyester resin of a transparent resin layer on OHP projected image quality and occurrence of offset.

The improvement in both the color formation properties of a projected image and the anti-offset properties can also be achieved when the transparent resin has a weight average molecular weight (Mw) ranging from 15000 to 40000 as shown in FIG. 4 and a weight average molecular weight (Mw) to number average molecular weight (Mn) ratio (Mw/Mn) of from 3.5 to 10 as shown in FIG. 5.

The thickness of the transparent resin layer also concerns the quality of a projected image and occurrence of offset. With a thin transparent resin layer, offset rarely occurs, but because there is no room enough for a toner to be embedded to a sufficient depth, the toner image has unevenness, failing to assure satisfactory projected image quality. If that thickness if too large, on the other hand, the layer is apt to be separated on fixing to cause offset.

The peak count value, initial count value, weight average molecular weight, and number average molecular weight of the transparent resin or the toner binder resin were measured as follows. A gel-permeation chromatograph Model HLC-802A manufactured by Tosoh Corp. and GP chromatographic columns GMH 6 were used. Tetrahydrofuran (solvent) was passed through the column at a rate of 1 ml/min, and 5 mg of a 0.1 g/20 ml sample solution in tetrahydrofuran was poured therein. Polystyrene was used as a standard. Measurement conditions were selected so that the measured molecular weights of the samples may fall within the range in which the molecular weight vs. count number plots of the calibration curve prepared by using several kinds of monodispersed polystyrene standard samples form a straight line.

According to JP-A-2-263642, compatibility between a toner binder resin and a resin of an image-receiving layer is evaluated in terms of solubility parameter. This is not always favorable for evaluation of the compatibility at the time of heat fixation. It has been revealed that the compatibility can be evaluated better by using the toner itself which is to be transferred to a film to be transferred.

The inventors discovered a concept "contact angle of a molten toner" (molten toner tilt angle) as a measure for properly evaluating the compatibility between the transparent resin and the toner. "Contact angle of a molten toner" is measured as follows.

Figure 8:
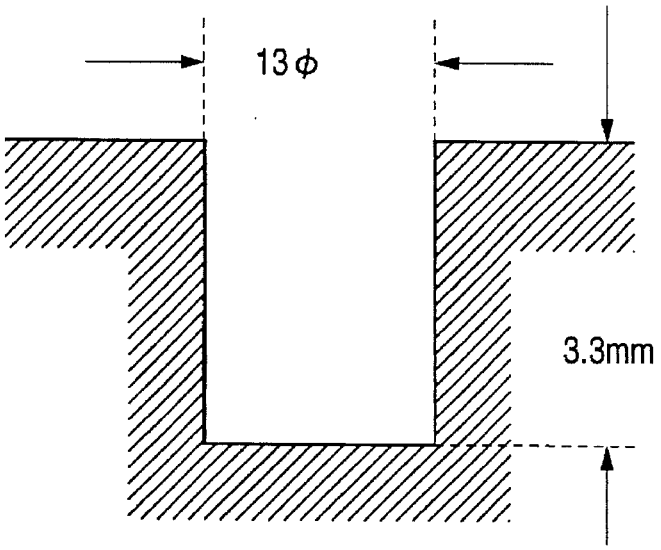
FIG. 8 is a cross section of a frame for tableting a toner into a disk to be used for measurement of a contact angle in a molten state.
Figure 9:
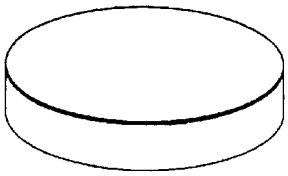
FIG. 9 is a perspective view of a toner disk to be used for measurement of a contact angle in a molten state.

1) Molding of Toner Disk:

A toner powder is packed in a tableting frame Hand Press Model SSP-10 (manufactured by Shimadzu Corp.) having an impression of 13 mm in diameter and 33 mm in depth as shown in FIG. 8, and a load of 1 t was applied with the hand press for 1 minute to obtain a toner disk having, as a standard, a diameter of 13 mm, a thickness of 1.2 mm, and a weight of 0.183 g (see FIG. 9).

Figure 10:
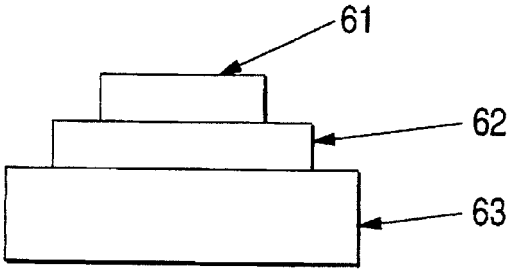
FIG. 10 is a schematic cross section of an apparatus for melting and solidification of a toner disk to be used for measurement of a contact angle.

2) Melting and Solidification of Toner:

See FIG. 10. Film to be transferred 62 was placed on hot plate 63, and toner disk 61 was put thereon. The hot plate was set a temperature about 20° C. lower than the temperature of a fixing unit, and the toner disk was allowed to melt at that temperature over a period of 90 seconds. Thereafter, film to be transferred 62 with the molten toner on it was placed on an alumina plate of 420 mm×297 mm for 1 minute to quench and solidify the molten toner.

3) Measurement of Contact Angle (molten toner tilt angle):

The contact angle of the solidified toner with the film to be transferred (the angle formed between the foot of the toner and the film to be transferred) was measured twice with a contact angle measuring instrument PACE manufactured by Kyowa Kaimen Kagaku K.K., and the average of the two measured values was obtained.

The film for electrophotographic transfer according to the invention comprises a transparent plastic film having on at least one side thereof a transparent resin layer comprising a polyester resin. In one embodiment of the invention, the film is characterized in that the peak count value (A) of the molecular weight distribution of the transparent resin as measured by GPC and the peak count value (B) of the binder resin of a color toner to be fixed as measured by GPC satisfy relationship: $-30 \leqq A-B \leqq +20$, the initial count value in the GPC molecular weight measurement of the transparent resin (Cp) and the initial count value in the GPC molecular weight measurement of the binder resin of a color toner to be fixed (Ct) satisfy relationship: $-500 \leqq Cp - Ct \leqq -200$, the transparent resin layer has a thickness ranging from 1 to 8 μm, and the contact angle between the transparent resin layer and a toner to be fixed which is molten at the fixing temperature is not more than 50°. This film is particularly suitable for providing a transparency having a color image and has resistance against offset.

In another embodiment of the invention, the OHP film of the invention is characterized in that the transparent resin has a weight average molecular weight of from 15000 to 40000 and a weight average molecular weight (Mw) to a number average molecular weight (Mn) ratio of form 3.5 and 10, the transparent resin layer has a thickness ranging from 1 to 8 μm, and the contact angle between the transparent resin layer and a toner to be fixed which is molten at the fixing temperature is not more than 50°. This film is particularly suitable for providing a transparency having a color image and has resistance against offset.

Figure 6:
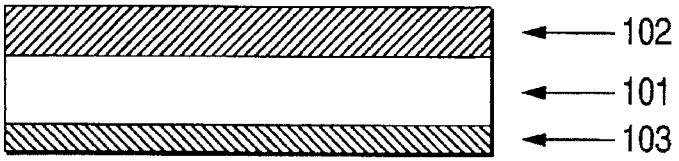
FIG. 6 is a cross section of an electrophotographic transfer film of the invention, which has a transparent resin layer on one side thereof.
Figure 7:
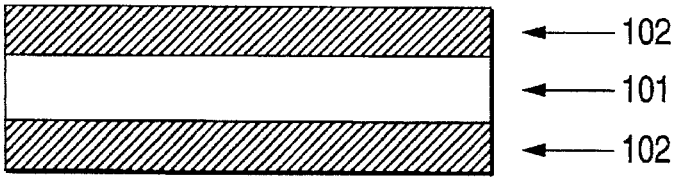
FIG. 7 is a cross section of an electrophotographic transfer film of the invention, which has a transparent resin layer on both sides thereof.

The film for electrophotographic transfer of the invention will be illustrated by way of its cross section shown in FIGS. 6 and 7. In the Figures, numeral 101 is a plastic film, and numeral 102 is a transparent resin layer. The film to be transferred of FIG. 6 has antistatic layer 103 on the side opposite to transparent resin layer 102. The film to be transferred of FIG. 7 has transparent layer 102 on both sides of plastic film 101.

The transparent plastic film used as the film for electrophotographic transfer has a heat resistance temperature of 100° C. or higher and includes a polyethylene terephthalate film, a polyethylene naphthalate film, a polysulfone film, a polyphenylene terephthalate film, a polyimide film, a polycarbonate film, a cellulose ester film, and a polyamide film. A polyethylene terephthalate film is preferred for its heat resistance and transparency.

If the heat resistance temperature of the plastic film is lower than 100° C., the film undergoes deformation, i.e., waving, on heat fixing of a toner and does not withstand practical use. The plastic film should have a sufficient thickness so as not to generate wrinkles even when it is soft by the heat of fixation. Such a thickness is generally 50 μm or more, preferably 75 μm or more. The upper limit of the thickness is 200 μm, preferably 150 μm, taking reduction of light transmission into consideration. Accordingly, the thickness of the heat resistance plastic film is selected from the range of 50 to 200 μm, preferably 75 to 150 μm.

While not limiting, the polyester resin which forms the transparent resin layer includes those comprising a bisphenol A ethylene oxide adduct, a bisphenol A propylene oxide adduct, terephthalic acid and glycerol; those comprising a bisphenol A propylene oxide adduct and fumaric acid; those comprising a bisphenol A ethylene oxide adduct, dodecenylsuccinic acid and terephthalic acid; and those comprising a bisphenol A ethylene glycol adduct, fumaric acid and isopropylene glycol. In selecting the transparent resin from the standpoint of the contact angle of a molten toner, polyester resins forming a contact angle of not more than 50° with a molten color toner are preferred.

The polyester resin preferably has such a molecular weight distribution that the peak count value (A) has a relationship with the peak count value of the toner binder resin to be fixed (B) as represented by $-30 \leqq A-B \leqq +20$, still preferably $-20 \leqq A-B \leqq +20$, and the initial count value (Cp) has a relationship with that of the toner binder resin to be fixed (Ct) as represented by $-500 \leqq Cp-Ct \leqq -200$, still preferably $-400 \leqq Cp-Ct \leqq -250$. Further, the polyester resin preferably has a weight average molecular weight (Mw) of from 15000 to 40000, still preferably from 20000 to 30000, and a weight average molecular weight (Mw) to number average molecular weight (Mn) ratio, Mw/Mn, of from 3.5 to 10, still preferably 4 to 7.

If the peak count value of the molecular weight distribution of the polyester resin is greater than that of a toner binder resin to be fixed by more than 20 ($A-B>20$), the molecular weight distribution of the polyester resin is shifted toward the lower molecular weight side. This means that the resin is softened more than the toner binder resin at the toner fixing temperature, and an offset phenomenon tends to occur. If the former peak count value is smaller than the latter peak count value by more than 30 ($B-A>30$), the molecular weight distribution of the polyester resin is shifted to the higher molecular weight side. This means that the resin is hardly softened even when the toner binder resin melts at the fixing temperature so that the color toner cannot be embedded in the transparent resin layer. It follows that the color toner image forms unevenness on the transparent resin layer to reduce the color formation properties when projected.

In GPC molecular weight measurement, the initial count value of the polyester resin (Cp) and that of the toner binder resin to be fixed (Ct) should satisfy relationship: $-500 \leqq Cp-Ct \leqq -200$. If $(Cp-Ct)$ is less than $-500$, which means that the polyester resin contains high molecular weight components in a large proportion as compared with the toner binder resin, the resin is not softened at the toner fixing temperature. As a result, the color toner is not embedded in the transparent resin layer, and the toner image forms unevenness on the transparent resin layer to reduce the color formation properties when projected. If $(Cp-Ct)$ is larger than $-200$, the high molecular weight region of the polyester resin is narrower than that of the toner binder resin. As a result, the transparent resin becomes too soft at the toner fixing temperature, easily causing offset.

If the weight average molecular weight (Mw) of the polyester resin is less than 15000, the image-receiving layer suffers from offset. If it exceeds 40000, the toner cannot be embedded in the transparent resin layer on fixing to cause unevenness particularly in the middle tone area. As a result, indent light is irregularly reflected, failing to provide satisfactory projected image quality.

If the weight average molecular weight (Mw) to number average molecular weight (Mn) ratio is less than 3.5, offset of the image-receiving layer occurs similarly in the case where the weight average molecular weight is less than 15000. If that ratio (Mw/Mn) exceeds 10, the toner cannot be embedded in the transparent resin layer similarly in the case where the weight average molecular weight exceeds 30000, causing unevenness particularly in the middle tone area. As a result, incident light is irregularly reflected, failing to obtain satisfactory projected image quality.

The thickness of the transparent resin layer ranges from 1 to 8 μm, preferably from 2 to 6 μm. If it is less than 1 μm, the color toner cannot be surely embedded in the inside of the transparent resin layer, causing unevenness particularly in the middle tone area. As a result, incident light is irregularly reflected, failing to provide satisfactory projected image quality. If the thickness exceeds 8 μm, the layer tends to be separated at the time of fixing to cause offset.

The film for electrophotographic transfer of the invention is prepared as follows.

The above-described polyester resin is dissolved in one or more of an alcohol (e.g., methanol or ethanol), a ketone (e.g., acetone or methyl ethyl ketone), and a chlorinated hydrocarbon (e.g., methylene chloride, ethylene chloride or tetrachlorethane); or ethyl acetate, tetrahydrofuran, and the like. The resin solution is applied to a plastic film by bar coating, dip coating, spray coating, spin coating or the like technique.

If desired, the transparent resin layer may contain a matting agent for film-to-film friction coefficient adjustment or an antistatic agent.

Useful matting agents include fine particles of silica, starch or alumina, and powdered plastics (e.g., polyethylene, polyester, polyacrylonitrile and polymethyl methacrylate). The matting agent is preferably used in an amount of 0.1 to 10% by weight based on the resin.

Suitable antistatic agents include alkylbenzimidazole sulfonates, naphthalenesulfonates, carboxylic acid sulfone esters, phosphoric esters, heterocyclic amines, ammonium salts, sulfonium salts, phosphonium salts, betaine type amphoteric salts, and metal oxides, such as ZnO, $SnO_2$, $Al_2O_3$, $In_2O_3$, MgO, BaO, and $MoO_3$.

Where a transparent resin layer is provided on only one side of a plastic film, it is preferable to form an antistatic layer on the other side. The same antistatic agent as incorporated into the transparent resin layer can be used as an antistatic layer.

The toner which may be used in the color image formation of the invention will be explained below. Since a toner to be used in an indirect dry process full color electrophotographic apparatus is required to have satisfactory fusibility and color mixing properties when heat is applied, it is preferable to use a toner having sharp melting properties. As previously described, it is preferable that the binder resin of the toner has such a molecular weight distribution that a peak count value is close to that of the transparent resin and an initial count value is greater than that of the transparent resin. In view of the compatibility with the transparent resin, the toner binder resin can be selected from among polyester resins of the same kinds as the transparent resins and polyester resins comprising a bisphenol A propylene oxide adduct and fumaric acid.

The color toner of the invention can be prepared by melt kneading toner forming materials, such as a binder resin, a colorant (dyes or pigments), a charge control agent, and the like, and grinding and classifying the blend.

The color image formation according to the present invention is explained below.

Figure 11:
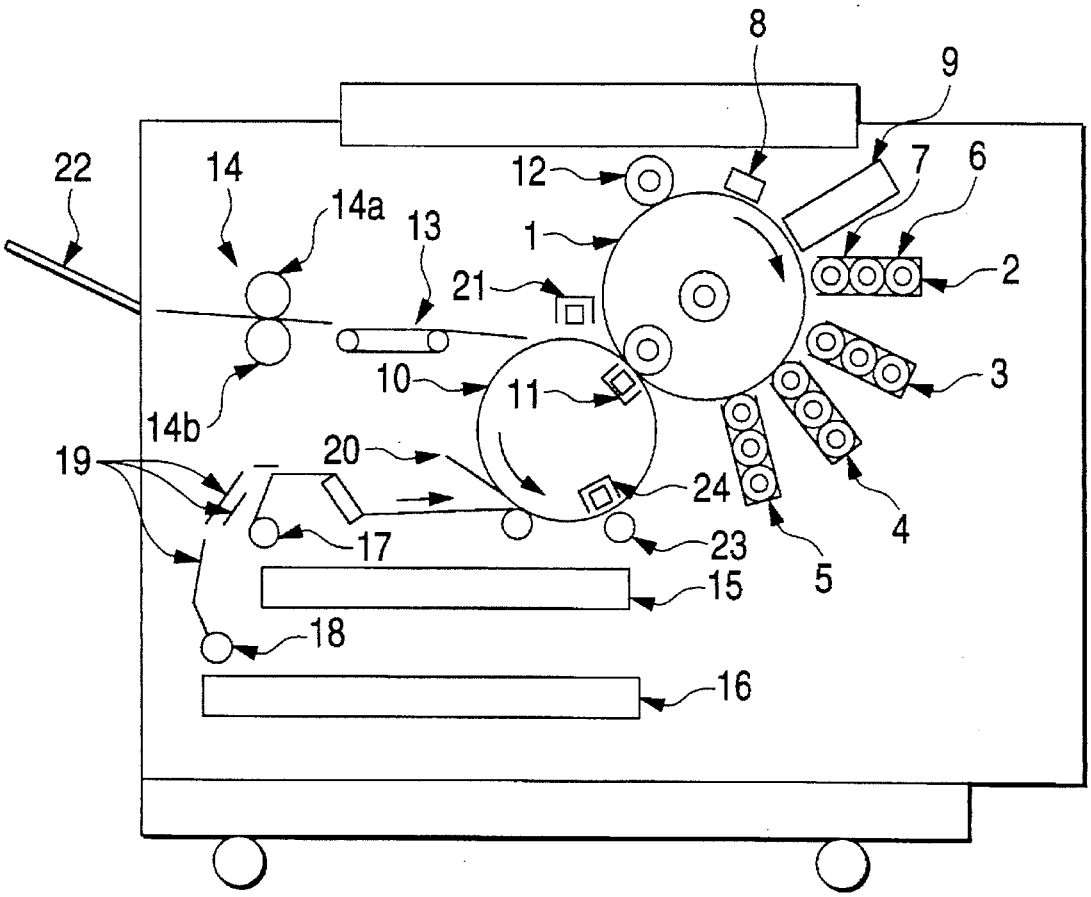
FIG. 11 is a schematic cross section of an indirect dry process electrophotographic apparatus used for color image formation on the film of the invention.

FIG. 11 schematically illustrates an example of the electrophotographic apparatus with which a full color image can be formed according to the invention. The apparatus is sectioned into a transfer material transportation system provided from the lower to middle part of the apparatus, a latent image formation part which is provided near transfer drum 10 constituting the transfer material transportation system, and a development part provided near the latent image formation part.

The transfer material transportation system is composed of film feed trays 15 and 16 which are provided under the main body of the apparatus, feed rollers 17 and 18 which are provided right above the feed trays, feed guides 19 and 20 which are provided near the feed rollers, transfer drum 10 which is provided near feed guide 20 and rotates in the direction indicated by the arrow, charger 21 for separation of a transfer material which is provided near the periphery of the transfer drum, transfer unit 11 and electrode 24 which are provided on the inner side of the transfer drum, contact roller 23 in contact with the periphery of the transfer drum, conveyor 13, fixing unit 14 which is provided near the end of the conveyor, and removable output tray 22.

The latent image formation part is provided in contact with the periphery of transfer drum 10. It is composed of electrostatic latent image carrier (photoreceptor drum) 1 rotating in the direction indicated by the arrow, charger 8 which is provided near the periphery of the latent image carrier, writing unit 9 which has an aligner for forming an electrostatic latent image on the surface of the latent image carrier, such as a laser beam scanner, and a light reflecting means, such a polygon mirror, and cleaning unit 12.

The development part is composed of developer carriers 7 and housings 6. It comprises black developing unit 2, magenta developing unit 3, cyan developing unit 4, and yellow developing device 5, which are provided at positions facing the surface of the latent image carrier for visualization (development) of the electrostatic latent image formed on the surface of the latent image carrier.

Electrophotographic image formation using the above-described apparatus is carried out in the following order, taking a full color mode for instance. Electrostatic latent image carrier 1 rotates in the direction indicated by the arrow, whereupon its surface is uniformly charged by charger 8. Then a laser beam modulated according to black image signals of an original (not shown) is applied through writing unit 9 to the charged photoreceptor to form an electrostatic latent image thereon, which is then developed by black developing unit 2.

On the other hand, a transfer material is fed from feed tray 15 or 16 and transported under guidance of guide 19 or 20 to transfer drum 10, where it is wound around transfer drum 10 electrostatically by electrode 24 facing contact roller 23. Transfer drum 10 is rotating to the direction indicated by the arrow synchronously with latent image carrier 1. The image visualized by black developing unit 2 is transferred from the latent image carrier 1 to the transfer material on transfer drum 10 at their contact site by means of transfer unit 11. Transfer drum keeps on rotating to be prepared for transfer of next color image (magenta image in the case of FIG. 9).

After the transfer, latent image carrier 1 is destaticized by a destaticizer (not shown), cleaned by cleaning unit 12, re-charged by charger 8, and receives latent image-forming light according to magenta image signals in the same manner as for the black image. The thus formed latent image is developed by magenta developing unit 3 to provide a visual image, which is then transferred to the transfer material. Subsequently, a cyan image and a yellow image are successively transferred to the transfer material in the same manner as described above. The multicolor visual image thus formed on the transfer material is destaticized by charger 21, forwarded to fixing unit 14 by means of conveyor 13, and fixed under heat and pressure to complete a cycle of full color image formation.

Fixing unit 14 is comprised mainly of heat roll **14*a* and pressure roll 14*b* having a similar structure. Heat roll 14*a*** has a 500 W Quartz lamp in the inside. It is composed of a steel-made support roll having an outer diameter of 44 mm as a core and a rubber layer made of a fluorine rubber, e.g., Viton Rubber produced by E.I. du Pont, provided on the support roll via an appropriate primer, having a rubber hardness (JIS) of 60° and a thickness of 40 μm. The pressure roll is structurally similar to the heat roll and is composed of a steel-made support roll having an outer diameter of 48 mm as a core and an inner elastic layer made of a silicone rubber having a thickness of 1 mm, provided on the support roll.

An oil donor roll (not shown), a means for supplying a release agent comprising dimethylpolysiloxane having a functional group (e.g., an amino group) to the heat roll, is provided in contact with the heat roll in order to improve the release properties of the fluorine rubber surface. The release agent is supplied to the oil donor roll by an oil pickup roll dipped in an oil pan.

Heat roll 14*a* and pressure roll 14*b* are brought into contact with each other under pressure by a nip pressure mechanism to form a nip width of 6 mm in the middle part. The surface temperature of both rolls is set at 150° C. Both the heat roll and the pressure roll rotate to the opposite directions as indicated by the arrow at a surface speed of 60 mm/sec.

The present invention will now be illustrated in greater detail by way of Examples, but it should be understood that the invention is not construed as being limited thereto. Unless otherwise indicated, all the percents and parts are by weight. All the molecular weight measurements were made by GPC.

EXAMPLE 1

A composition consisting of ethyl acetate, 20%, based on ethyl acetate, of a polyester resin (bisphenol A ethylene oxide adduct/bisphenol A propylene oxide adduct/terephthalic acid/glycerol) having an Mw of 23100, an Mw/Mn ratio of 5.9, a peak count value of 3453, and an initial count value of 2718, and 0.5%, based on the polyester, of an alkyl phosphate type surface active agent as an antistatic agent was coated on a 100 μm thick polyester film by bar coating to form a transparent resin layer having a dry thickness of 4 μm to prepare a film for electrophotographic transfer.

A cyan toner was prepared by mixing 96 parts of a polyester resin (bisphenol A propylene oxide adduct/fumaric acid) having an Mw of 11000, an Mw/Mn ratio of 2.9, a peak count value of 3456, and an initial count value of 3050, 1 part of a quaternary ammonium salt as a charge control agent, and 3 parts of a cyan pigment. Magenta, yellow, and black toners were prepared in the same manner except for replacing the cyan pigment with a magenta pigment, a yellow pigment or a black pigment. Each color toner prepared had a volume average particle size of 7 μm.

The volume average particle size of toner particles was obtained by measuring a particle size distribution of particles having a particle diameter of 2 to 50 μm with a Coulter counter TA-II Model (manufactured by Coulter Co.) at an aperture of 100 μm.

The contact angle of the resulting toner in a molten state on the transparent resin layer was 44° as measured according to the above-described method.

A color image was formed on the resulting film for electrophotographic transfer using an electrophotographic apparatus shown in FIG. 11 loaded with the resulting color toners according to the following conditions. The amount of the black toner to be transferred for an original having a dot area ratio of 100% was set at 1.0 mg/cm$^2$, while that amount of the other toners was adjusted to 0.65 mg/cm$^2$. Patches having a yellow, magenta or cyan dot image area of 100% or 36% were printed on the OHP film and heat and pressure fixed at a fixing roll temperature of 150° C. for an average heating time of 100 msec. Each of the resulting color images formed on the OHP film having an input dot area ratio of 100% (Cin 100%) or 36% (Cin 36%) was evaluated by measuring the ratio of specularly transmitted light, called projection efficiency (hereinafter abbreviated as PE). Because the results obtained for the same dot area ratio were equal irrespective of color, only the results of a yellow image will be shown. Occurrence of offset was also observed.

The ratio of specularly transmitted light, i.e., PE was measured with a spectrophotometer in which the angle of view of the integrating sphere was 7°, by using a 2° field color matching function and the standard illuminant A as a standard light source, and calculated according to the following equation:

$$PE=\log[\Sigma\{P(\lambda)+N(\lambda)\}/n]/\log\{\Sigma(\lambda)/n\}$$

wherein λ is a wavelength; P(λ) is a specular transmittance at wavelength λ; N(λ) is a diffused transmittance at wavelength λ; and n is the number of data sampled in the visible light region.

A higher PE value means a larger proportion of specular transmission, indicating that an OHP projected image is clearer. On the other hand, a lower PE value means a lower proportion of specular transmission, indicating that an OHP projected image shows poorer color formation. On examining the correspondence between a PE value (%) and visual observation of a projected image, a projected image having a PE value of 75% or more exhibits excellent color reproducibility. Accordingly, a PE value of 75% or more was taken as an acceptable level.

The anti-offset properties were evaluated in 3 grades:

1 . . . No offset occurs.

2 . . . The toner is slightly lifted.

3 . . . The image-receiving layer resin is caught by the fixing roll.

As a result of evaluation, PE was 89% in the Cin 100% area and 82% in the Cin 36% area, and no offset occurred. The OHP film was thus proved to accomplish the objects in terms of projected image quality and anti-offset properties.

EXAMPLE 2

An OHP film was prepared in the same manner as in Example 1, except for using an polyester resin (bisphenol A propylene oxide adduct/fumaric acid) having an Mw of 15400, and Mw/Mn ratio of 3.5, a peak count value of 3446, and an initial count value of 2850.

A color image was formed on the OHP film and evaluated in the same manner as in Example 1. The contact angle of a molten toner and the transparent resin layer 46° as measured in the same manner as in Example 1.

PE was 89% in the Cin 100% area and 80% in the Cin 36% area, and no offset occurred. The OHP film was thus proved to accomplish the objects in terms of projected image quality and anti-offset properties.

EXAMPLE 3

An OHP film was prepared in the same manner as in Example 1, except for using a polyester resin (bisphenol A propylene oxide adduct/fumaric acid) having an Mw of 20400, an Mw/Mn ratio of 4.2, a peak count value of 3431, and an initial count value of 2763.

A color image was formed on the OHP film and evaluated in the same manner as in Example 1. The contact angle of a molten toner and the transparent resin layer was 45° as measured in the same manner as in Example 1.

PE was 88% in the Cin 100% area and 81% in the Cin 36% area, and no offset occurred. The OHP film was thus proved to accomplish the objects in terms of projected image quality and anti-offset properties.

EXAMPLE 4

An OHP film was prepared in the same manner as in Example 1, except for using a polyester resin (bisphenol A propylene oxide adduct/fumaric acid) having an Mw of 15500, an Mw/Mn ratio of 3.7, a peak count value of 3476, and an initial count value of 2840.

A color image was formed on the OHP film and evaluated in the same manner as in Example 1. The contact angle of a molten resin and the transparent resin layer was 46° as measured in the same manner as in Example 1.

PE was 88% in the Cin 100% area and 79% in the Cin 36% area, and no offset occurred. The OHP film was thus proved to accomplish the objects in terms of projected image quality and anti-offset properties.

EXAMPLE 5

An OHP film was prepared in the same manner as in Example 1, except for applying the polyester resin coating composition to a dry thickness of 1 μm.

A color image was formed on the OHP film and evaluated in the same manner as in Example 1. The contact angle of a molten resin and the transparent resin layer was 44° as measured in the same manner as in Example 1.

PE was 89% in the Cin 100% area and 76% in the Cin 36% area, and no offset occurred. The OHP film was thus proved to accomplish the objects in terms of projected image quality and anti-offset properties.

EXAMPLE 6

An OHP film was prepared in the same manner as in Example 1, except for applying the polyester resin coating composition to a dry thickness of 8 μm.

A color image was formed on the OHP film and evaluated in the same manner as in Example 1. The contact angle of a molten toner and the transparent resin layer was 44° as measured in the same manner as in Example 1.

PE was 89% in the Cin 100% area and 80% in the Cin 36% area, and no offset occurred. The OHP film was thus proved to accomplish the objects in terms of projected image quality and anti-offset properties.

Comparative Example 1

An OHP film was prepared in the same manner as in Example 1, except for using a polyester resin (bisphenol A ethylene oxide adduct/dodecenylsuccinic acid/terephthalic acid) having an Mw of 12500, an Mw/Mn ratio of 3.2, a peak count value of 3429, and an initial count value of 2970.

A color image was formed on the OHP film and evaluated in the same manner as in Example 1. The contact angle of a molten toner and the transparent resin layer was 45° as measured in the same manner as in Example 1.

The OHP film attained the object of projected image quality as having a PE of 85% in the Cin 100% area and 79% in the Cin 36% area, but offset occurred.

Comparative Example 2

An OHP film was prepared in the same manner as in Example 1, except for using a polyester resin (bisphenol A ethylene oxide adduct/bisphenol A propylene oxide adduct/terephthalic acid/glycerol) having an Mw of 41500, an Mw/Mn ratio of 10.5, a peak count value of 3421, and an initial count value of 2530.

A color image was formed on the OHP film and evaluated in the same manner as in Example 1. The contact angle of a molten toner and the transparent resin layer was 51° as measured in the same manner as in Example 1.

As a result of evaluation, offset did not take place, but the projected image quality fell short of the object as having an PE of 88% in the Cin 100% area and 74% in the Cin 36% area.

Comparative Example 3

An OHP film was prepared in the same manner as in Example 1, except for using a polyester resin (bisphenol A ethylene oxide adduct/bisphenol A propylene oxide adduct/succinic acid derivative/terephthalic acid/trimellitic anhydride) having an Mw of 50000, and Mw/Mn ratio of 13.1, a peak count value of 3406, and an initial count value of 2520.

A color image was formed on the OHP film and evaluated in the same manner as in Example 1. The contact angle of a molten toner and the transparent resin layer was 55° as measured in the same manner as in Example 1.

As a result of evaluation, offset did not take place, but the projected image quality fell short of the object as having an PE of 87% in the Cin 100% area and 70% in the Cin 36% area.

Comparative Example 4

An OHP film was prepared in the same manner as in Example 1, except for using a polyester resin (bisphenol A propylene oxide adduct/fumaric acid) having an Mw of 13300, an Mw/Mn ratio of 3.3, a peak count value of 3481, and an initial count value of 2862.

A color image was formed on the OHP film and evaluated in the same manner as in Example 1. The contact angle of a molten toner and the transparent resin layer was 46° as measured in the same manner as in Example 1.

The OHP film attained the object of projected image quality as having a PE of 87% in the Cin 100% area and 78% in the Cin 36% area, but offset occurred.

Comparative Example 5

An OHP film was prepared in the same manner as in Example 1, except for applying the polyester resin coating composition to a dry thickness of 0.5 μm.

A full color image was formed on the OHP film and evaluated in the same manner as in Example 1. The contact angle of a molten toner and the transparent resin layer was 44° as measured in the same manner as in Example 1.

As a result of evaluation, offset did not occur, but the projected image quality fell short of the object as having a PE of 84% in the Cin 100% area and 73% in the Cin 36% area.

Comparative Example 6

An OHP film was prepared in the same manner as in Example 1, except for applying the polyester resin coating composition to a dry thickness of 9 μm.

A color image was formed on the OHP film and evaluated in the same manner as in Example 1. The contact angle of a molten toner and the transparent resin layer was 44° as measured in the same manner as in Example 1.

As a result of evaluation, the OHP film attained the object of projected image quality as having a PE of 88% in the Cin 100% area and 79% in the Cin 36% area, but offset occurred.

The results of evaluation in Example and Comparative Examples are shown in Tables 1 and 2 below.

TABLE 1

| | Example 1 | Example 2 | Example 3 | Example 4 | Example 5 | Example 6 |
|---|---|---|---|---|---|---|
| Properties of Transparent Resin: | | | | | | |
| Peak Count Value (A) | 3453 | 3446 | 3431 | 3476 | 3453 | 3453 |
| Initial Count Value (Cp) | 2718 | 2850 | 2763 | 2840 | 2718 | 2718 |
| A - B* | −3 | −10 | −25 | −20 | −3 | −3 |
| Cp - Ct** | −332 | −200 | −287 | −210 | −332 | −332 |
| Mw | 23100 | 15400 | 20400 | 15500 | 23000 | 23000 |
| Mw/Mn | 5.9 | 3.5 | 4.2 | 3.7 | 5.9 | 5.9 |
| Contact Angle with Molten Toner (°) | 44 | 46 | 45 | 46 | 44 | 44 |
| Image-Receiving Layer Thickness (μm) | 4 | 4 | 4 | 4 | 1 | 8 |
| Results of Evaluation: | | | | | | |
| PE (%); Yellow Toner | 89 | 89 | 88 | 88 | 89 | 89 |
| Cin 100% Area | (pass) | (pass) | (pass) | (pass) | (pass) | (pass) |
| PE (%); Yellow Toner | 82 | 80 | 81 | 79 | 76 | 80 |
| Cin 36% Area | (pass) | (pass) | (pass) | (pass) | (pass) | (pass) |
| Grade of Offset | 1 | 1 | 1 | 1 | 1 | 1 |
| | (pass) | (pass) | (pass) | (pass) | (pass) | (pass) |

| | Compara. Example 1 | Compara. Example 2 | Compara. Example 3 | Compara. Example 4 | Compara. Example 5 | Compara. Example 6 |
|---|---|---|---|---|---|---|
| Properties of Transparent Resin: | | | | | | |
| Peak Count Value (A) | 3429 | 3421 | 3406 | 3481 | 3453 | 3453 |
| Initial Count Value (Cp) | 2970 | 2530 | 2520 | 2862 | 2718 | 2718 |
| A - B* | −27 | −35 | −50 | 25 | −3 | −3 |
| Cp - Ct** | −80 | −520 | −530 | −189 | −332 | −332 |
| Mw | 12500 | 41500 | 50000 | 13300 | 23100 | 23100 |
| Mw/Mn | 3.2 | 10.5 | 13.1 | 3.3 | 5.9 | 5.9 |
| Contact Angle with Molten Toner (°) | 45 | 51 | 55 | 46 | 44 | 44 |
| Image-Receiving Layer Thickness (μm) | 4 | 4 | 4 | 4 | 0.5 | 9 |
| Results of Evaluation: | | | | | | |
| PE (%); Yellow Toner | 85 | 88 | 87 | 87 | 84 | 89 |
| Cin 100% Area | (pass) | (pass) | (pass) | (pass) | (pass) | (pass) |
| PE (%); Yellow Toner | 79 | 74 | 70 | 7 8 | 73 | 79 |
| Cin 36% Area | (pass) | (fail) | (fail) | (pass) | (fail) | (pass) |
| Grade of Offset | 2 | 1 | 1 | 2 | 1 | 2 |
| | (fail) | (pass) | (pass) | (fail) | (pass) | (fail) |

*Note: Peak count value of the toner binder resin.
**Initial count value of the toner binder resin.

As has been fully described and demonstrated, the present invention provides a film for electrophotographic transfer (OHP film) and an electrophotographic image formation method, by which an OHP projected image which is free from cloudiness in the middle tone area and excellent in color formation properties can be obtained, and a toner image can be stably fixed under heat and pressure without causing an offset phenomenon of the image-receiving transparent resin layer.

While the invention has been described in detail and with reference to specific examples thereof, it will be apparent to one skilled in the art that various changes and modifications can be made therein without departing from the spirit and scope thereof.

What is claimed is:

1. A developed electrophotographic transfer film comprising a color toner having a binder resin fused to an electrophotographic transfer film, wherein the electrophotographic transfer film comprises a transparent plastic film having a heat resistance temperature of 100° C. or higher, having provided on at least one side thereof a transparent resin layer comprising a polyester transparent resin, wherein a peak count value (A) of a molecular weight distribution of said transparent resin as measured by gel-permeation chromatography (GPC) and a peak count value (B) of the binder resin of the color toner used for fixing as measured by GPC satisfy relationship (1):

$$-30 \leqq A-B \leqq +20 \quad (1)$$

an initial count value in the GPC molecular weight measurement of said transparent resin (Cp) and an initial count value in the GPC molecular weight measurement of the binder resin of the color toner used for fixing (Ct) satisfy relationship (2):

$$-500 \leqq Cp-Ct \leqq -200 \quad (2)$$

said transparent resin layer has a thickness ranging from 1 to 8 μm, and said transparent resin layer forms a contact angle of not more than 50° with the color toner binder resin, the transparent resin layer and the color toner binder resin being dissolved in one another.

2. A developed electrophotographic transfer film comprising a color toner having a binder resin fused to an electrophotographic transfer film, wherein the electrophotographic transfer film comprises a transparent plastic film having a heat resistance temperature of 100° C. or higher, having provided on at least one side thereof a transparent resin layer comprising a polyester transparent resin, wherein said transparent resin has (i) a weight average molecular weight (Mw) of from 15000 to 40000 and (ii) a weight average molecular weight (Mw) to number average molecular weight (Mn) ratio of from 3.5 to 10, said transparent resin layer has a thickness ranging from 1 to 8 μm, and said transparent resin layer forms a contact angle of not more than 50° with the color toner binder resin, the transparent resin layer and the color toner binder resin being dissolved in one another.

3. The developed electrophotographic transfer film as claimed in claim 1, wherein the binder resin of the color toner is a polyester resin.

4. The developed electrophotographic transfer film as claimed in claim 2, wherein the color toner comprises a polyester resin as a binder resin.

5. A method for color image formation comprising developing an electrostatic latent image with a color toner comprising a binder resin to prepare a color toner image, transferring the color toner image onto a film for electrophotographic transfer to prepare a transferred toner image, and fixing the transferred toner image under heat and pressure, wherein the film for electrophotographic transfer comprises a transparent plastic film having a heat resistance temperature of 100° C. or higher, having provided on at least one side thereof a transparent resin layer comprising a polyester transparent resin, wherein a peak count value (A) of a molecular weight distribution of said transparent resin as measured by gel-permeation chromatography (GPC) and a peak count value (B) of the binder resin of the color toner used for fixing as measured by GPC satisfy relationship (1):

$$-30 \leqq A-B \leqq +20 \quad (1)$$

an initial count value in the GPC molecular weight measurement of said transparent resin (Cp) and an initial count value in the GPC molecular weight measurement of the binder resin of the color toner used for fixing (Ct) satisfy relationship (2):

$$-500 \leqq Cp-Ct \leqq -200 \quad (2)$$

said transparent resin layer has a thickness ranging from 1 to 8 μm, and said transparent resin layer forms a contact angle of not more than 50° with the color toner binder resin in a molten state in which the transparent resin layer and the color toner binder resin dissolve in one another.

6. A method for color image formation comprising developing an electrostatic latent image with a color toner comprising a binder resin to prepare a color toner image, transferring the color toner image onto a film for electrophotographic transfer to prepare a transferred toner image, and fixing the transferred toner image under heat and pressure, wherein the film for electrophotographic transfer comprises a transparent plastic film having a heat resistance temperature of 100° C. or higher, having provided on at least one side thereof a transparent resin layer comprising a polyester transparent resin, wherein said transparent resin has (i) a weight average molecular weight (Mw) of from 15000 to 40000 and (ii) a weight average molecular (Mw) to number average molecular weight (Mn) ratio of from 3.5 to 10, said transparent resin layer has a thickness ranging from 1 to 8 μm, and said transparent resin layer forms a contact angle of not more than 50° with the color toner binder resin in a molten state in which the transparent resin layer and the color toner binder resin dissolve in one another.

7. The method as claimed in claim 5, wherein the binder resin of the color toner is a polyester resin.

8. The method as claimed in claim 6, wherein the binder resin of the color toner is a polyester resin.

* * * * *